United States Patent [19]

Niemann et al.

[11] 4,325,530

[45] Apr. 20, 1982

[54] CRYOGENIC STRUCTURAL SUPPORT

[75] Inventors: Ralph C. Niemann, Downers Grove; Karl F. Mataya, Lemont; John D. Gonczy, Oak Lawn, all of Ill.

[73] Assignee: The United States of America as represented by the United States Department of Energy, Washington, D.C.

[21] Appl. No.: 882,726

[22] Filed: Mar. 2, 1978

[51] Int. Cl.[3] ..... A47H 1/10

[52] U.S. Cl. ..... 248/317; 62/514 R

[58] Field of Search ..... 248/317, 323, 327, 328, 248/58, 59, 60; 62/514 R, 295, 465

[56] References Cited

U.S. PATENT DOCUMENTS

| | | | |
|---|---|---|---|
| 2,059,848 | 11/1936 | Cavitt | 248/317 |
| 2,122,375 | 6/1938 | Kovac | 248/317 |
| 2,689,464 | 9/1954 | Wurtz | 62/295 |
| 2,780,429 | 2/1957 | Vanier | 248/60 X |
| 3,261,579 | 7/1966 | Engman et al. | 248/60 |

*Primary Examiner*—J. Franklin Foss

*Attorney, Agent, or Firm*—Paul A. Gottlieb; Linda Shapiro; James E. Denny

[57] ABSTRACT

A tensile support member is provided for use in a cryogenic environment. The member is in the form of a link formed of an epoxy glass laminate with at least one ply of the laminate having its fibers aligned circumferentially about the link.

2 Claims, 4 Drawing Figures

FIG 1
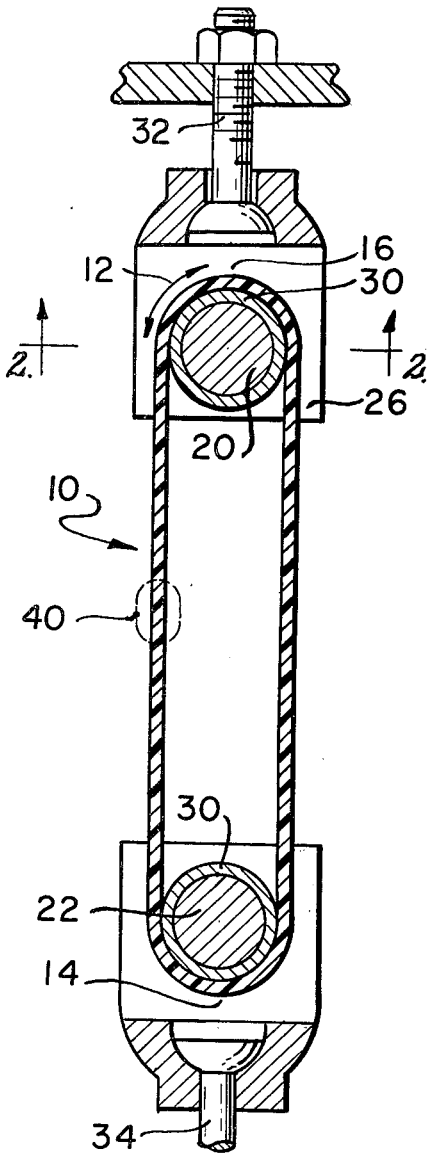
FIG 3
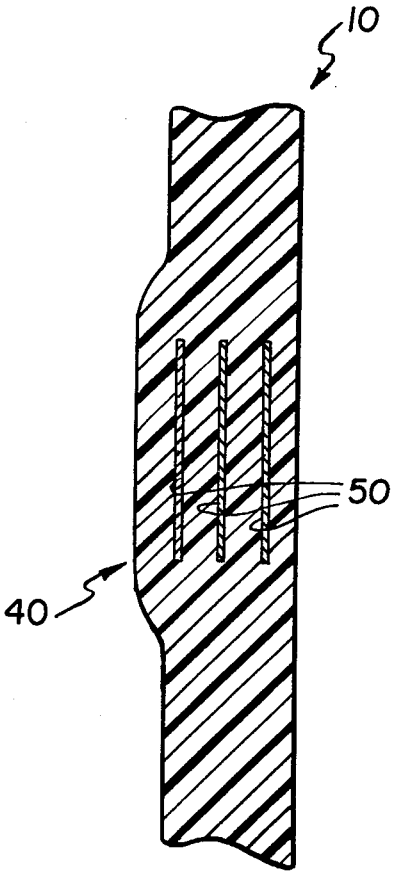
FIG 4
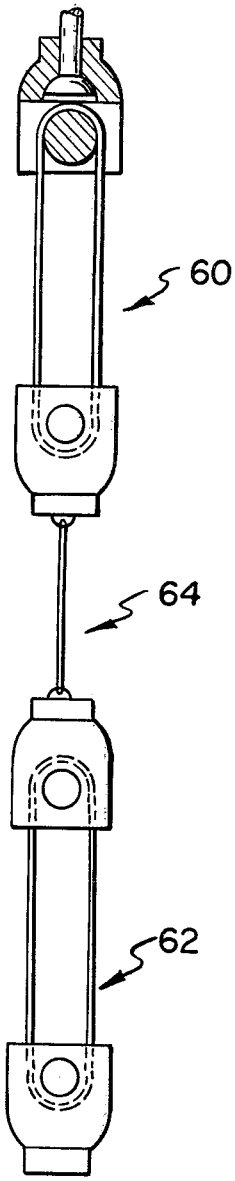
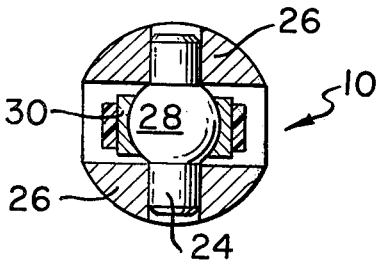
FIG 2

CRYOGENIC STRUCTURAL SUPPORT

CONTRACTUAL ORIGIN OF THE INVENTION

The invention described herein was made in the course of, or under, a contract with the UNITED STATES DEPARTMENT OF ENERGY.

BACKGROUND OF THE INVENTION

Cryogenic technology requires structural members which provide support at cryogenic temperatures, and supports which can provide support between extreme temperature differentials in a cryogenic environment with minimized heat transfer along the member. For example, present superconducting magnet design utilizes support members which extend between the superconducting temperature region at, say, 4.2 K (the temperature of liquid helium) and an outer insulating vacuum vessel region at, say, 300 K (temperature of the ambient conditions). The member must not only provide structural support but also minimize heat leak along the member.

It is therefore an object of this invention to provide a structural support member for use in a cryogenic environment.

Another object of this invention is to provide a low heat leak structural support member for use in a cryogenic environment.

SUMMARY OF THE INVENTION

A tensile support member is provided for use in a cryogenic environment. The member is in the form of a link. The link is formed by wrapping an epoxy glass laminate about a mandrel to form the link, with at least one ply of the laminate having its fibers aligned circumferentially about the link. The link is cured to form the structural member and the mandrel is removed. Cross plies can be added to provide for strength to resist torsion and/or flexure. Such a link exhibits low heat loss as compared with prior art stainless steel links. An intermediate heat intercept can be provided to improve heat resistance along the length of the link.

DESCRIPTION OF THE DRAWINGS

FIG. 1 shows a link type structural support member,

FIG. 2 shows a section through line 2—2 of FIG. 1,

FIG. 3 shows another embodiment of the member having an intermediate heat sink, and FIG. 4 shows an alternate embodiment having an intermediate heat sink and two links.

DETAILED DESCRIPTION OF THE INVENTION

Referring to FIG. 1 and FIG. 2 there is shown a link type tensile support member for use in a cryogenic environment. Such a tensile member might be used to support loads in a single-temperature cryogenic environment or to provide structural support to bridge the gap between a high and low-temperature region wherein the heat transfer capabilities of the member become significant in reducing maintenance costs. For example, the disclosed member could bridge the gap between the support body at 4.2 K and an outer vessel at 300 K. The geometry of the basic member as shown in FIG. 1 and FIG. 2 is that of a link 10 formed of an epoxy glass laminate in a manner to be described such that the fibers of at least one ply of the wrap lie parallel to the circumference of the link, i.e. parallel to arrow 12.

The link may be formed by wrapping uncured epoxy impregnated glass fiber cloth in layers about a form or mandrel having the desired inner dimensions of the link. Epoxy glass laminating media are available in tape or sheet form. In tape form, the fibers are oriented either across or parallel to the length of the tape so that the wrapping tape about the mandrel is easily accomplished. No adhesive is used in addition to the uncured epoxy with which the laminating media is impregnated. After wrapping to the desired thickness, the link is cured with the form in place in the usual manner such as by heating in an oven under uniform pressure by use of vacuum bagging or some similar technique. The links may be coated with a layer of epoxy polyimide varnish after their fabrication to prevent water migration into the material, thereby reducing the likelihood of stress corrosion in the glass fibers. Examples of suitable epoxy glass laminates are NASA Resin No. 2 with No. 143-75 glass cloth and Scotch Ply 1002 Cross Ply. The NASA first-mentioned composite consists of EPON 828 (a bisphenol A epoxy) 100 p.b.w., dodecenyl succinic anhydride (a flexibilizing curing agent) 115.9 p.b.w., Empol 1040 (a high-molecular weight tricarboxyl acid) 20 p.b.w. and benzyl dimethyl amine (a cure catalyst) 1 p.b.w. This composite has room-temperature ultimate tensile strength of 7000 kg/cm$^2$ in the fiber direction and 2100 kg/cm$^2$ in the cross fiber direction.

The strength of an epoxy glass laminate lies parallel to the fibers. By forming the length with the fibers aligned parallel to arrow 12, the link becomes a tensile strength member. Such a member exhibits high tensile strength at low cryogenic temperatures (77 K and below) and has a low heat conductance. Such a link has 1/30 the heat conductance of stainless steel between 300 K and 4.2 K. Low heat conductance is important where the member extends between a region of low temperature, say, at end 14 of the link and a region of higher temperature, say, at end 16 of the link.

In practice, means of coupling to the link are attached to either end 14 and 16. The means of coupling may simply be pins about which the link is free to rotate to provide flexibility. Such an assembly can be provided with an improved torsion strength by providing the link with one or more layers with fibers cross plied perpendicular to the circumferential plies.

As shown in FIG. 1 and FIG. 2, torsion flexibility can also be provided by coupling the link 10 with spherical bearing supports 20 and 22 at either end 14 and 16 of the link. These spherical bearings each include a shaft 24 supported by yoke 26. On each shaft is the spherical bearing 28 upon which is the race 30. The link 10 wraps around race 30 so that as link 10 twists, race 30 can slide about ball 28. Yokes 26 are appropriately coupled to the desired bodies by couplings 32 and 34.

To improve heat interception along the link to enhance the low heat conductance path along the link, a heat sink can be made a part of the link at an intermediate location 40 on both sides of the link between ends 14 and 16. FIG. 3 more particularly shows an example of such an intermediate heat sink which is made part of link 10 at location 40. The sink is formed during the wrapping process by inserting carefully sized strips of mold released brass between layers of the wrap at desired locations. After fabrication the strips are removed, leaving slots and strips of heat-conducting material 50 such as copper are then inserted and epoxied in place in order to assure good thermal contact. The copper strips act as a heat sink so that some of the heat traveling down the link dissipates through the copper and into an intermediate temperature reservoir between ends 14 and 16.

Another means of providing a heat sink is shown in FIG. 4. Here two links 60 and 62 are utilized with the lower link 62 being of epoxy glass laminate. The links are coupled together such as with a roller link 64 similar to that used in a bicycle chain which will also serve as an access point to a heat sink. Further, the upper link can be of a material such as stainless steel. This shortens the actual length of the epoxy glass laminate link. At the warmer temperature nearer link 64, a glass link may exhibit creep so that the use of the double links with the glass link 62 in the colder region and a steel link 64 in the warmer region will have a lessened possibility of failure due to creep.

The embodiments of the invention in which an exclusive property or privilege is claimed are defined as follows:

1. Tensile support member for use in a cryogenic environment, comprising:

an endless link formed of an epoxy glass laminate with at lease one ply of said laminate having fibers aligned circumferentially about said link; and at least one intermediate heat sink positioned on one side of said link between couplings of said link, said heat sink including at least one heat conductive metal strip contained within the plies of said laminate and extending out therefrom to form a heat conductive path.

2. Tensile support member for use in a cryogenic environment, comprising:

an endless link formed of an epoxy laminate with at least one ply of said laminate having fibers aligned circumferentially about said link; and at least one spherical bearing having a race riding on a spherical bearing, one end of said link being wrapped about said race.

* * * * *